US006774332B2

(12) United States Patent
Maehata et al.

(10) Patent No.: US 6,774,332 B2
(45) Date of Patent: Aug. 10, 2004

(54) COMPOSITE SEPARATOR

(75) Inventors: Hidehiko Maehata, Osaka (JP); Tetsuya Inoue, Osaka (JP); Shogo Hamada, Osaka (JP); Daisuke Tamakoshi, Osaka (JP); Hiroyuki Daiku, Osaka (JP)

(73) Assignee: Hitachi Zosen Corporation (JP)

( * ) Notice: Subject to any disclaimer, the term of this patent is extended or adjusted under 35 U.S.C. 154(b) by 47 days.

(21) Appl. No.: 10/149,504

(22) PCT Filed: Aug. 27, 2001

(86) PCT No.: PCT/JP01/07340

§ 371 (c)(1),
(2), (4) Date: May 20, 2002

(87) PCT Pub. No.: WO02/34404

PCT Pub. Date: May 2, 2002

(65) Prior Publication Data

US 2002/0189977 A1 Dec. 19, 2002

(30) Foreign Application Priority Data

Oct. 24, 2000 (JP) ..... 2000-323404

(51) Int. Cl.[7] ..... B03C 7/00
(52) U.S. Cl. ..... 209/128

(58) Field of Search ..... 209/127.1, 128, 209/129, 130

(56) References Cited

U.S. PATENT DOCUMENTS

| | | | | | |
|---|---|---|---|---|---|
| 2,187,637 | A | * | 1/1940 | Sutton et al. | 209/129 |
| 3,031,079 | A | * | 4/1962 | Boss | 209/128 |
| 3,322,275 | A | * | 5/1967 | Breakiron et al. | 209/127.1 |
| 4,116,822 | A | * | 9/1978 | Webb | 209/11 |
| 5,704,490 | A | * | 1/1998 | Reynard | 209/128 |

FOREIGN PATENT DOCUMENTS

| | | | | |
|---|---|---|---|---|
| JP | 09094482 | A | 4/1997 | B03C/7/06 |
| JP | 09299827 | A | 11/1997 | B03C/7/02 |
| JP | 2000126650 | A | 5/2000 | B03C/7/06 |

* cited by examiner

*Primary Examiner*—Donald P Walsh
*Assistant Examiner*—Joseph Rodriguez
(74) *Attorney, Agent, or Firm*—Kusner & Jaffe

(57) ABSTRACT

A composite sorting apparatus for separating conductive materials from non-conductive materials comprising a drum electrode, needle-shaped electrodes, and a plate-shaped electrode, wherein the plurality of needle-shaped electrodes are arranged so that the interval X in cm (in) between discharge sections of adjacent needle-shaped electrodes with respect to the distance $L_1$ in cm (in) from the tips of discharge sections to the drum electrode meets $0<X/L_1 \leqq 3$.

4 Claims, 6 Drawing Sheets

COMPOSITE SEPARATOR

TECHNICAL FIELD

The present invention relates to a composite sorting apparatus that separates a mixture into metal pieces (conductive materials) and plastic pieces (non-conductive materials).

BACKGROUND ART

Sorting apparatuses that sort a mixture into metals as conductive materials and plastics as non-conductive materials using electric force include an electrostatic type and a corona discharge type, as well as a composite type using both the electrostatic type and the corona discharge type.

As shown in FIG. 9, this composite sorting apparatus is composed of a specified amount supplying section 53 formed of a hopper 51 and a supply plate 52, a metal drum electrode 54 having a cylindrically formed surface and rotated in a predetermined direction (shown by arrow a) around a horizontal axis, a linear electrode 55 for corona discharge which is provided obliquely above the drum electrode 54 at a downward rotation side thereof and located opposite the drum electrode 54 at a predetermined distance therefrom, a plate-shaped electrode 56 arranged downstream of the linear electrode 55 and opposite the drum electrode 54 at a predetermined distance therefrom to form an electrostatic field, a power supply device 57 that applies high voltage between the drum electrode 54 and both the linear electrode 55 and the plate-shaped electrode 56, and a collecting container 58 arranged below the drum electrode 54 to collect sorted materials therein.

With this construction, the drum electrode 54, rotated in a predetermined direction, is grounded to act as a positive electrode, while the linear electrode 55 is used as a negative electrode, to subject the gas in non-uniform electric fields to corona discharge on the basis of the impact ionization action of electrons, thereby generating negative corona ions. The negative corona ions are applied to the drum electrode 54, and the plate-shaped electrode 56 is used as a negative electrode to form sorting electrostatic fields between the plate-shaped electrode 56 and the drum electrode 54. In this state, a mixture of metal pieces as conductive materials and plastic pieces as non-conductive materials is loaded from the hopper 51 onto the drum electrode 54 via the supply plate 52. Then, the mixture moves toward the downstream side of the drum electrode 54 in a rotating direction thereof as the drum electrode 54 rotates, while negative corona ions from the linear electrode 55 are applied to the metal and plastic pieces. The metal pieces, to which the corona ions have been applied, come into contact with the drum electrode 54, so that negative charges provided by the corona ions are neutralized by positive charges from the drum electrode 54. The drum electrode 54 further provides positive charges to the metal pieces. Thus, the metal pieces repel the drum electrode 54 and fall therefrom. On the other hand, the plastic pieces, to which the corona ions have been applied, are attracted to the drum electrode 54 due to negative charges provided by the corona ions.

Furthermore, in sorting electrostatic fields, the metal pieces, having positive charges, are attracted to the plate-shaped electrode 56 as a negative electrode, whereas the plastic pieces, having negative charges, are attracted to the drum electrode 54 due to electrostatic force acting thereon.

Thus, the mixture is separated into metal pieces and plastic pieces, which are then collected in the collecting container 58 located below the drum electrode 54.

However, with the conventional composite sorting apparatus, the linear electrode 55 that applies corona ions to the mixture of metal pieces and plastic pieces emits only a small amount of corona ions and non-uniformly applies corona ions to the mixture. Accordingly, a sufficient amount of corona ions cannot be applied to the mixture, thereby precluding the mixture from being precisely separated into the metal pieces and the plastic pieces.

DISCLOSURE OF INVENTION

Thus, the present invention solves the above problems, and it is an object thereof to provide a composite sorting apparatus that can precisely separate a mixture into metal pieces and plastic pieces.

To solve the above problems, the present invention provides a composite sorting apparatus comprising a rotationally moving electrode disposed so as to rotationally move in a predetermined direction, a discharge electrode for corona discharge which is provided opposite the rotationally moving electrode at a predetermined distance therefrom, a plate-shaped electrostatic electrode provided downstream of the discharge electrode and located opposite the rotationally moving electrode at a predetermined distance therefrom to form an electrostatic field between the electrostatic electrode and the rotationally moving electrode, wherein high voltage of a polarity opposite to that of the rotationally moving electrode is applied between the rotationally moving electrode and both the discharge electrode and electrostatic electrode, a mixture of metal pieces and plastic pieces is loaded onto the rotationally moving electrode, corona ions are applied to the mixture from the discharge electrode, and the mixture is introduced into said electrostatic field so as to be separated into the metal pieces and the plastic pieces, the apparatus being characterized in that the discharge electrode has a plurality of discharge sections each having a sharp tip, the discharge sections are provided in a cross direction of the rotationally moving electrode at predetermined intervals, and arranged so that an interval X cm (in) between adjacent discharge sections with respect to a distance $L_1$ in cm (in) from tips of the discharge sections to the rotationally moving electrode meets the following expression (1), the discharge sections are each formed so that an area formed on the rotationally moving electrode and to which corona ions are applied has a diameter three times as large as the distance $L_1$ in cm (in), and a voltage $V_1$(kV) applied between the discharge electrode and the rotationally moving electrode meets the following expression (2):

$$0<X/L_1\leqq 3 \quad (1)$$

$$0.5\ kV/cm\ (1.27\ kV/in)\leqq V_1/L_1\leqq 10\ kV/cm\ (25.4\ kV/in) \quad (2).$$

With respect to the above construction, it has been found that corona ions generated by the discharge electrode having discharge sections each having the sharp tip mostly come from the tip of the discharge section. It has also been found that in a facility environment used for the sorting apparatus, the discharge sections of the discharge electrode each form an ion applied area having a width three times as large as the distance $L_1$ from the tip of the discharge section and the rotationally moving electrode. Accordingly, by setting the interval X between the adjacent discharge sections equal to a value that meets the expression (1), areas to which corona ions from the discharge sections are applied are located at least in contact with each other. Consequently, corona ions are applied to the entire area of the rotationally moving electrode in its cross direction, to ensure a sufficient corona-ion-applied time required for separation, thereby improving separation precision.

Furthermore, the voltage applied per 1 cm (0.3937 in) in the distance between the discharge electrode and the rotationally moving electrode is between 0.5 kV/cm (1.27 kV/in) and 10 kV/cm (25.4 kV/in), thereby ensuring that a sufficient amount of corona ions are generated and preventing the occurrence of a spark (short circuit), which precludes the generation of corona ions. Thus, an amount of corona ions required for separation can be generated.

Accordingly, a mixture of metal pieces and plastic pieces can be precisely separated into the metal pieces and the plastic pieces.

Further, a second aspect of the present invention is the above construction, characterized in that a plurality of rows each composed of a plurality of discharge sections arranged in the cross direction of the rotationally moving electrode are arranged in a rotational-movement direction of the rotationally moving electrode, and a distance D in cm (in) between the rows of discharge sections is set to meet the following expression (3):

$$D<3v+3L_1 \quad (3)$$

where v is the circumferential speed in cm/sec in/sec of the rotationally moving electrode.

With the above construction, the distance D between the rows of discharge sections arranged in the rotational-movement direction of the rotationally moving electrode is smaller than the distance that the mixture moves through the corona-ion-applied areas of the discharge section rows during +3 seconds. As a result, the time for which no corona ions are applied to the mixture is limited to shorter than 3 seconds. This prevents charges provided by corona ions from being released, thereby enabling the mixture to be effectively separated into metal pieces and plastic pieces.

Furthermore, a third aspect of the present invention is the above construction, characterized in that the plurality of rows of discharge sections are formed so that the discharge sections of one row are located offset from the corresponding discharge sections of the adjacent row in the cross direction of the rotationally moving electrode.

In the above construction, since the plurality of rows of discharge sections are formed so that the discharge sections of one row are located offset from the corresponding discharge sections of the adjacent row in the cross direction of the rotationally moving electrode, the mixture, moving as the rotationally moving electrode moves rotationally, spends uniform time in passing through the corona-ion-applied areas in the cross direction of the rotationally moving electrode. Consequently, a uniform amount of charges provided by corona ions are applied to the mixture.

Moreover, a fourth aspect of the present invention is the above construction, characterized in that the electrostatic electrode is formed to have, in a direction orthogonal to the rotational-movement direction of the rotationally moving electrode, a length that is substantially the same as the width of the rotationally moving electrode, the electrostatic electrode is formed to have, in the rotational-movement direction of the rotationally moving electrode, a length that is one-tenth or more of a diameter of the rotationally moving electrode, and a voltage $V_2$(kV) applied between the electrostatic electrode and rotationally moving electrode is set to meet the following expression (4):

$$0.5\ kV/cm\ (1.27\ kV/in) \leqq V_2/L_2 \leqq 10\ kV/cm\ (25.4\ kV/in) \quad (4)$$

where $L_2$ is the shortest distance in cm (in) between the electrostatic electrode and the rotationally moving electrode.

In the above construction, since the electrostatic electrode is formed to have, in the direction orthogonal to the rotational-movement direction of the rotationally moving electrode, the length that is substantially the same as the width of the rotationally moving electrode, a uniform electrostatic field is formed over substantially the entire rotationally moving electrode in its cross direction, thereby applying electrostatic force to the mixture, that is, the plastic and metal pieces, depending on the polarity of the charges and the amount of charges. Further, since the electrostatic electrode is formed to have, in the rotational-movement direction of the rotationally moving electrode, the length that is one-tenth or more of the diameter of the rotationally moving electrode, sufficient time can be used to pass the mixture through the electrostatic field, resulting in precise separation. Furthermore, the voltage applied per 1 cm (0.3937 in) in the distance between the electrostatic electrode and the rotationally moving electrode is set between 0.5 kV/cm (1.27 kV/in and 10 kV/cm (25.4 kV/in), thereby preventing the electrostatic field from having an excessively low intensity, which results in weak electrostatic force applied to the mixture. This prevents separation precision from decreasing and also prevents a decrease in separation precision caused by the lack of an electrostatic field resulting from a spark (short circuit) between the electrostatic electrode and the rotationally moving electrode. Therefore, the mixture can be precisely separated into metal pieces and plastic pieces.

In the present invention, the distance $L_1$ in cm (in) from the discharge section of the discharge electrode to the rotationally moving electrode is shown as the distance from the tip of the discharge section as described above, but the distance D between the plurality of discharge section rows arranged in the rotational-movement direction of the rotationally moving electrode is also shown as the distance between the tips of the discharge sections forming the adjacent rows.

Further, when the plurality of rows of discharge sections are formed so that the discharge sections of one row are located offset from the corresponding discharge sections of the adjacent row in the cross direction of the rotationally moving electrode, the discharge sections are arranged so that segments joining the discharge sections forming one row to the corresponding discharge sections forming the adjacent row in the cross direction of the rotationally moving electrode are in what is called a zigzag form.

Further, the length of the electrostatic electrode in the rotational-movement direction of the rotationally moving electrode has no particular upper limit. If this length is too large, the mixture of metal pieces and plastic pieces may bounce of f the electrostatic electrode, so that the sorted plastic pieces may be mixed with metal pieces. This may reduce the purity with which the plastic pieces are sorted out or the recovery of the plastic pieces or the like. Thus, in a practical sense, this length is preferably eight-tenths or less of the diameter of the rotationally moving electrode.

BEST MODE FOR CARRYING OUT THE INVENTION

A composite sorting apparatus according to an embodiment of the present invention will be described with reference to FIGS. 1 to 5.

Figure 1:
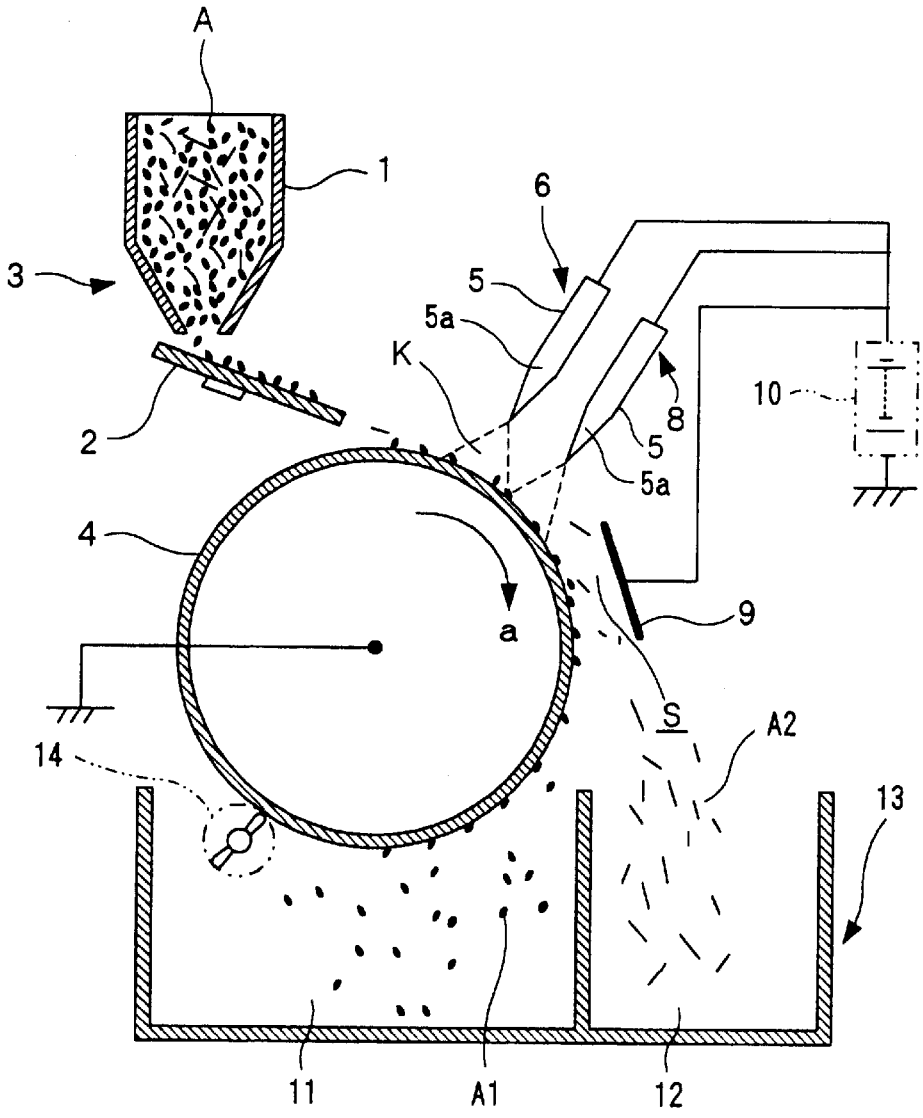
FIG. 1 is a sectional view schematically showing a construction of a composite sorting apparatus according to an embodiment of the present invention.

FIG. 1 is a sectional view schematically showing the construction of the sorting apparatus according to the embodiment of the present invention. As shown in FIG. 1, this sorting apparatus is composed of a specified amount supplying section 3 formed of a hopper 1 and a supply plate 2, a metal drum electrode (an example of a rotationally moving electrode) 4 having a cylindrically formed surface and rotated in a predetermined direction (shown by arrow a) around a horizontal axis, a first row of discharge electrodes 6 and a second row of discharge electrodes 8 which are provided obliquely above the drum electrode 4 at a downward rotation side thereof and located opposite the drum electrode 4 at a predetermined distance therefrom, a plate-shaped electrode 9 (an example of an electrostatic electrode) arranged downstream of the first and second rows of discharge electrodes 6 and 8 and opposite the drum electrode 4 at a predetermined distance therefrom to form a sorting electrostatic field, a power supply device 10 that applies high voltage between the drum electrode 4 and each of the first row of discharge electrodes 6, the second row of discharge electrodes 8, and the plate-shaped electrode 9, and a collecting container 13 arranged below the drum electrode 4 and composed of a first collecting chamber 11 and a second collecting chamber 12 to collect sorted materials therein.

The first row of discharge electrodes 6 and the second row of discharge electrodes 8 are formed of a plurality of needle-shaped electrodes (examples of discharge electrodes) 5 for corona discharge provided in the cross direction of the drum electrode 4 at predetermined intervals.

Figure 2:
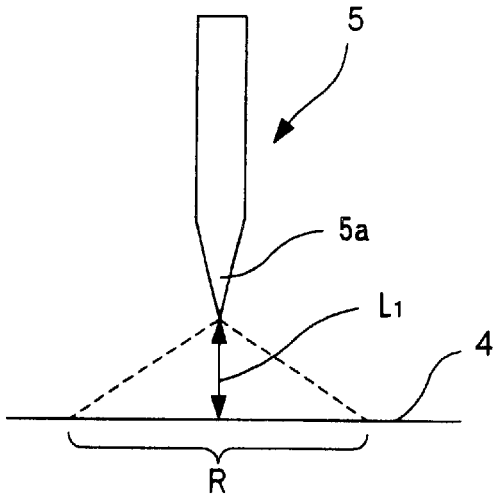
FIG. 2 is a view useful in describing an essential part of the sorting apparatus.

As shown in FIG. 2, the needle-shaped electrode 5 has a coned discharge section Sa formed at its tip and which applies corona ions K to a surface of the drum electrode 4 on the basis of corona discharge. When the discharge section 5*a* is subjected to corona discharge, it forms a circular area R on the drum electrode 4 to which corona ions K are applied, having a diameter three times as large as the distance $L_1$ in cm (in) from the tip of the discharge section 5*a* to the drum electrode 4.

Figure 3:
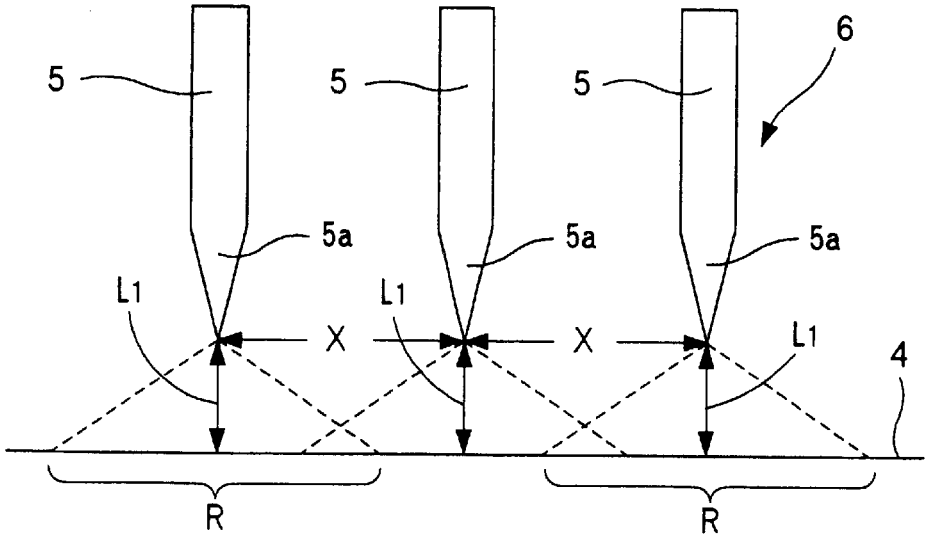
FIG. 3 is a view useful in describing an essential part of the sorting apparatus.

In the rows of discharge electrodes 6 and 8, the interval X cm (in) between the discharge sections 5*a* has a predetermined value depending on the distance $L_1$ in cm (in) from the tip of the discharge section 5*a* to the drum electrode 4. That is, as shown in FIG. 3, the interval X between the discharge sections 5*a* and 5*a* of the adjacent needle-shaped electrodes 5 is set at such a predetermined value that $X/L_1<3$. Thus the area R to which corona ions K radiated from the discharge sections 5*a* are formed overlap each other.

Figure 4:
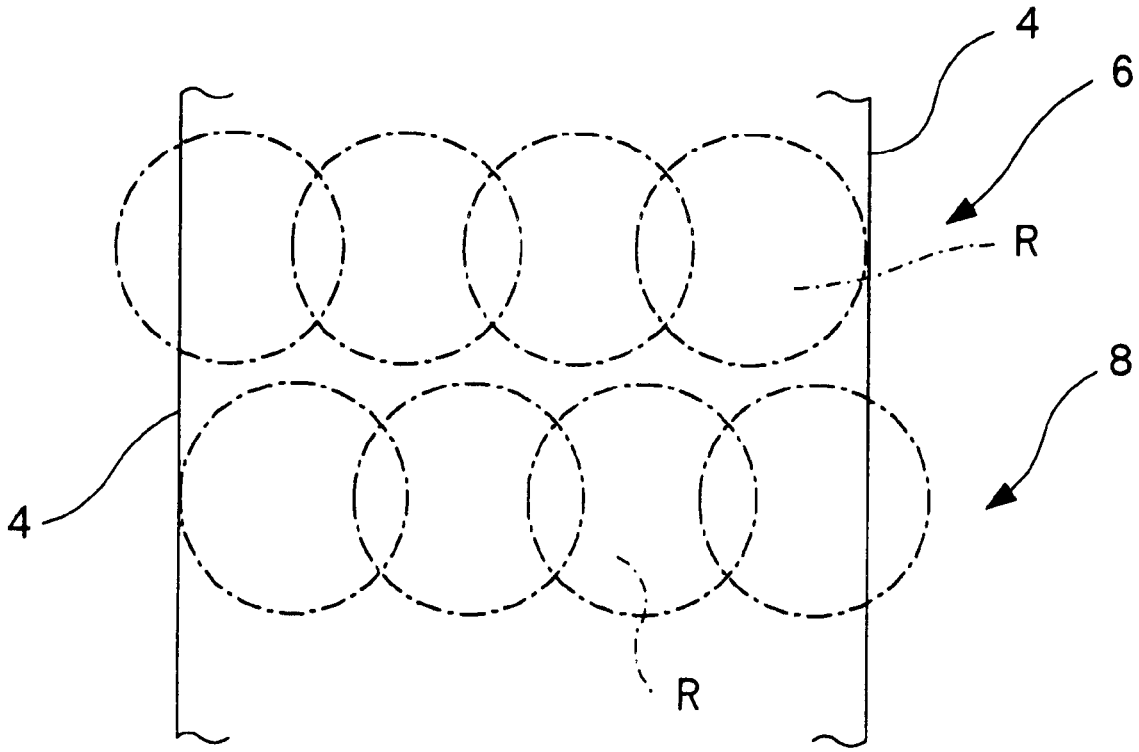
FIG. 4 is a view useful in describing an essential part of the sorting apparatus.

As shown in FIG. 4, for discharge electrodes 8, the discharge sections 5*a* of the needle-shaped electrodes 5 of the second row are located offset from the corresponding discharge sections 5*a* of the discharge electrodes of the first row of discharge electrodes 6 in the cross direction of the drum electrode 4 in a zigzag manner. The distance D between the first row of discharge electrodes 6 and the second row of discharge electrodes 8 is set so that $D<3v+3L_1$, that is, set so as to meet the above expression (3), depending on the distance $L_1$ in cm (in) from the tip of the discharge section 5*a* to the drum electrode 4. Accordingly, the first row of discharge electrodes 6 and the second row of discharge electrodes 8 are separated at a predetermined distance.

Figure 5:
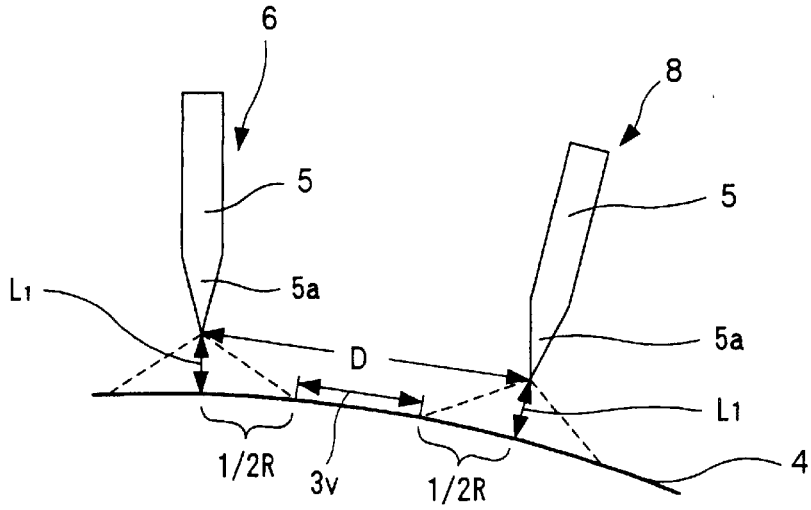
FIG. 5 is a view useful in describing an essential part of the sorting apparatus.

Here, for $D<3v+3L_1$, indicating the distance D between the adjacent discharge electrode rows 6 and 8, two areas ½R to which corona ions a half of K are applied are formed by the needle-shaped electrodes 5 of between the discharge electrode rows 6 and 8, as shown in FIG. 5, and $R=3L_1$. Consequently, $3L_1$ corresponds to an area R formed between the discharge electrode rows 6 and 8 and to which corona ions K are applied. Further, since 3 v indicates the distance that the sorted material moves during 3 seconds, the distance D between the discharge electrode rows 6 and 8 is smaller than the sum of the width of the area R between the discharge electrode rows 6 and 8 to which corona ions K are applied and the distance that the sorted material moves during 3 seconds. Accordingly, the distance D between the first row of discharge electrodes 6 and the second row of discharge electrodes 8 in FIG. 4 is set so that the time during which no corona ions are applied to the drum electrode is limited to less than 3 seconds. This is because if charges provided to the sorted material by the application of the corona ions are left for 3 seconds or more, they are spontaneously emitted to reduce the amount of charges, thus reducing separation precision.

A predetermined voltage $V_1$ that meets 0.5 kV/cm (1.27 kV/in) $V_1/L_1 \leqq 10$ kV/cm (25.4 kV/in), that is, the above expression (2), is applied per 1 cm (0.3937 in) in the distance between the needle-shaped electrode 5 and the drum electrode 4. This is because below 0.5 kV/cm (1.27 kV/in), an excessively small amount of corona ions K are generated to reduce the separation precision and because above 10 kV/cm (25.4 kV/in), a spark (short circuit) occurs to preclude the generation of corona ions K, also reducing the separation precision.

The plate-shaped electrode 9, arranged downstream of the second row of discharge electrodes 8, is formed of a plate or a circular plate. The plate-shaped electrode 9 is formed to have, in the direction orthogonal to the rotating direction of the drum electrode 4, the same length as the width of the drum electrode 4 and the plate-shaped electrode 9 is formed to have, in the rotating direction of the drum electrode 4, a predetermined length that is one-tenth or more of the diameter of the drum electrode 4.

A predetermined voltage $V_2$ that meets 10.5 kV/cm (1.27 kV/in) $\leqq V_2/L_2 \leqq 10$ kV/cm (25.4 kV/in), that is, the above expression (4), is applied per 1 cm (0.3937 in) in the distance between the plate-shaped electrode 9 and the drum electrode 4. This is because below 0.5 kV/cm (1.27 kV/in), the electrostatic field has an excessively low intensity and the sorted material is subjected to a weak electrostatic force, thereby reducing the separation precision, and because above 10 kV/cm (25.4 kV/in), a spark occurs between the plate-shaped electrode 9 and the drum electrode 4 to preclude the formation of an electrostatic field, also reducing the separation precision.

With the above construction, the drum electrode 4, rotated in the predetermined direction (shown by arrow a), is grounded to act as a positive electrode, and the needle-shaped electrodes 5 constituting the first row of discharge electrodes 6 and the second row of discharge electrodes 8 are used as a negative electrode 5. Then, the power supply device 10 applies a high voltage between the drum electrode 4 and both discharge electrode rows 6 and 8. The gas in a non-uniform electric field is subjected to corona discharge on the basis of an impact and separation action of electrons, to generate negative corona ions K, which are then applied to the drum electrode 4. Further, the plate-shaped electrode 9 is used as a negative electrode, and the power supply device 10 forms a sorting electrostatic field S between the plate-shaped electrode 9 and the drum electrode 4. Then, a specified amount of a mixture A of plastic pieces A1 obtained by, for example, crushing a wasted plastic-coated wire and a copper wire (metal pieces) A2 is supplied through the hopper 1 to the supply plate 2, vibrated in the vertical direction. The mixture A is then dropped to a surface of the drum electrode 4.

The mixture A dropped to the surface of the drum electrode 4 moves as the drum electrode 4 rotates, while being subjected to corona ions K generated by the needle-shaped electrodes 5 due to corona discharge. Consequently, the mixture A is provided with negative charges.

The plastic pieces A1 of the mixture A are attracted to the drum electrode 4 due to negative charges provided by corona ions K arising from corona discharge from the needle-shaped electrodes 5. Furthermore, in the sorting electrostatic field S formed between the plate-shaped electrode 9 and the drum electrode 4, electrostatic force acts on the plastic pieces A1, having the negative charges, to attract the plastic pieces A1 to the drum electrode 4. The plastic pieces A1 attracted to the drum electrode 4 move as the drum electrode 4 rotates and then fall following a falling track that approaches the drum electrode 4 or are scraped by a scraping member 14. Thus, the plastic pieces A1 are collected in the first collecting chamber 11.

On the other hand, the copper wire A2 of the mixture A comes into contact with the drum electrode 4, so that the negative charges applied to the copper wire A2 by the corona ions K are neutralized. Then, positive charges from the drum electrode 4 are applied to the copper wire A2, which thus repels the drum electrode 4. Furthermore, in the sorting electrostatic field S, the copper wire A2 is attracted to the plate-shaped electrode 9 as a negative electrode and jumps following a falling track that leaves the drum electrode 4. Thus, the copper wire A2 is collected in the second collecting chamber 12.

In this construction, the first row of discharge electrodes 6 is formed so that the areas R to which corona ions K radiated from the adjacent needle-shaped electrodes 5 are applied overlap each other. Accordingly, the corona ions K are applied to the entire mixture A in the cross direction of the drum electrode 4. Thus, the corona ions K are applied to the entire drum electrode 4 in its cross direction, thereby ensuring a sufficient corona-ion-K-applied time required for separation. Further, since the discharge sections 5*a* of the second row of discharge electrodes 8 are located offset from the corresponding discharge sections 5*a* of the first row of discharge sections 6 in the cross direction of the drum electrode 4 in a zigzag form, the mixture A, moving as the drum electrode 4 moves rotationally, spends uniform time in passing through each corona-ion-K-applied area R in the cross direction of the drum electrode 4. Consequently, a uniform amount of charges provided by the corona ions K are applied to the mixture A.

Furthermore, the plate-shaped electrode 9 is formed to have, in the direction orthogonal to the rotating direction of the drum electrode 4, a length that is the same as the width of the drum electrode 4, and the plate-shaped electrode 9 is formed to have, in the rotating direction of the drum electrode 4, a predetermined length that is one-tenth or more of the diameter of the drum electrode 4. Consequently, a uniform electrostatic field S is formed over substantially the entire drum electrode 4 in its cross direction, and electrostatic force is applied to the mixture A, that is, the plastic pieces A1 and the copper wire A2, depending on the polarity of the charges and the amount of charges. Further, sufficient time can be used to pass the mixture A through the electrostatic field.

Furthermore, the predetermined voltage $V_1$ meeting the above expression (2) is applied between the needle-shaped electrode 5 and the drum electrode 4, thereby ensuring that a sufficient amount of corona ions K are generated and preventing the occurrence of a spark (short circuit), which precludes the generation of corona ions K. Thus, an amount of corona ions K required for separation can be generated.

Moreover, the predetermined voltage $V_2$ meeting the above expression (4) is applied between the plate-shaped electrode 9 and the drum electrode 4, thereby preventing the electrostatic field S from having an excessively low intensity, which results in weak electrostatic force applied to the mixture. This prevents the separation precision from decreasing and also prevents a decrease in separation precision caused by the lack of an electrostatic field resulting from a spark between the plate-shaped electrode 9 and the drum electrode 4.

Consequently, the mixture A of the plastic pieces A1 and the copper wire A2 can be precisely separated into the plastic pieces A1 and the copper wire A2.

In the embodiment shown in FIGS. 1 to 5, the drum electrode 4 is used as a rotationally moving electrode, but a rotationally moving electrode may be formed by winding an endless metal belt around a plurality of rotating members so that a mixture to be sorted can be dropped onto the metal belt, moving in a horizontally extending state.

Further, in the embodiment shown in FIGS. 1 to 5, the plurality of needle-shaped electrodes 5 are used as a discharge electrode for corona discharge, but an electrode may be composed of an electrode plate disposed to extend over the entire drum electrode 4 in its cross direction and discharge sections protrudingly arranged at the tip edge of the electrode plate at specified intervals.

Figure 6:
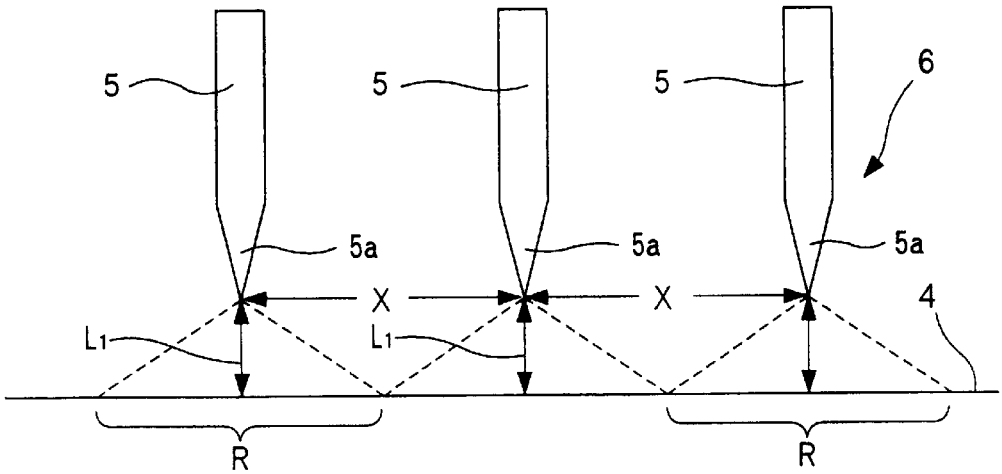
FIG. 6 is a view useful in describing a composite sorting apparatus according to another embodiment of the present invention.

FIG. 6 shows a composite sorting apparatus according to another embodiment of the present invention. In the embodiment shown in FIGS. 1 to 5, the adjacent needle-shaped electrodes 5 are arranged so that the distance X between the discharge sections 5*a* meets $X/L_1=3$ and so that the areas R to which corona ions K from the adjacent needle-shaped electrode 5 are applied are in contact with each other. According to this construction, the mixture A can be precisely separated into the copper wire A2 and the plastic pieces A1, though this construction may be less precise than the above embodiment.

Figure 7:
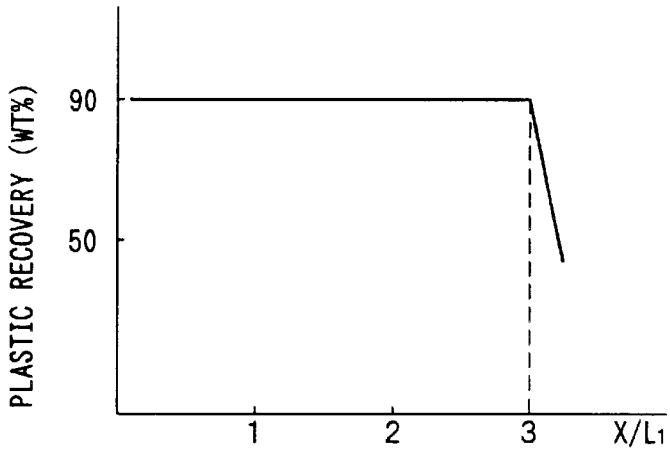
FIG. 7 is a graph showing a relationship between $X/L_1$ and plastic recovery.
Figure 8:
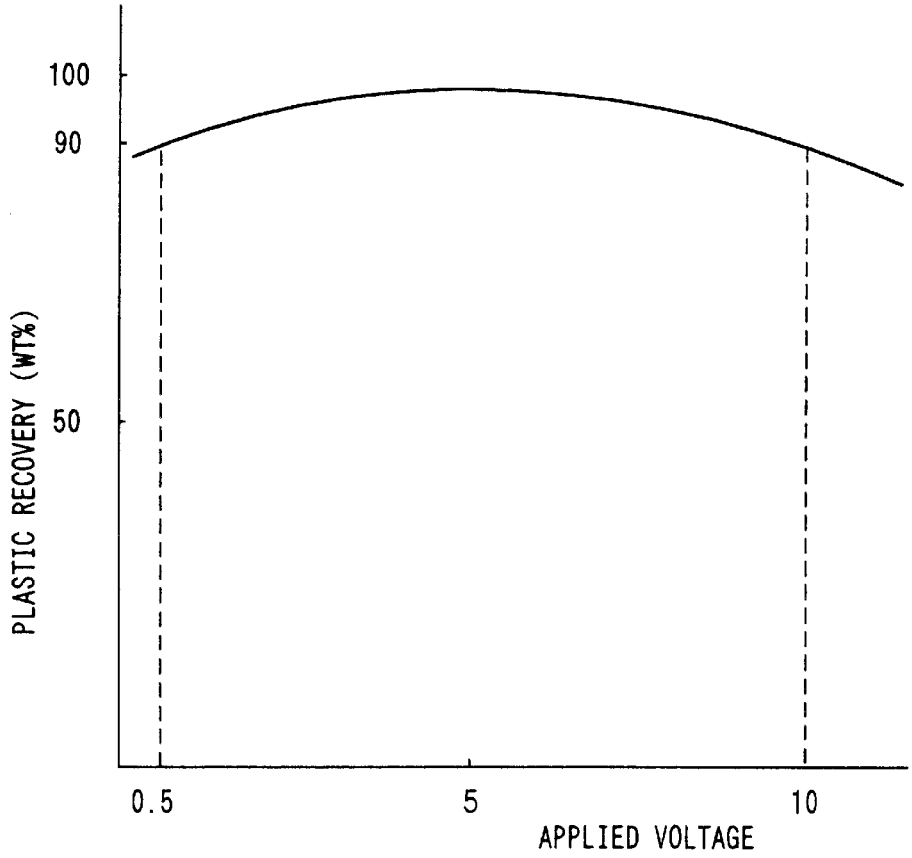
FIG. 8 is a graph showing a relationship between applied voltage and the plastic recovery.
Figure 9:
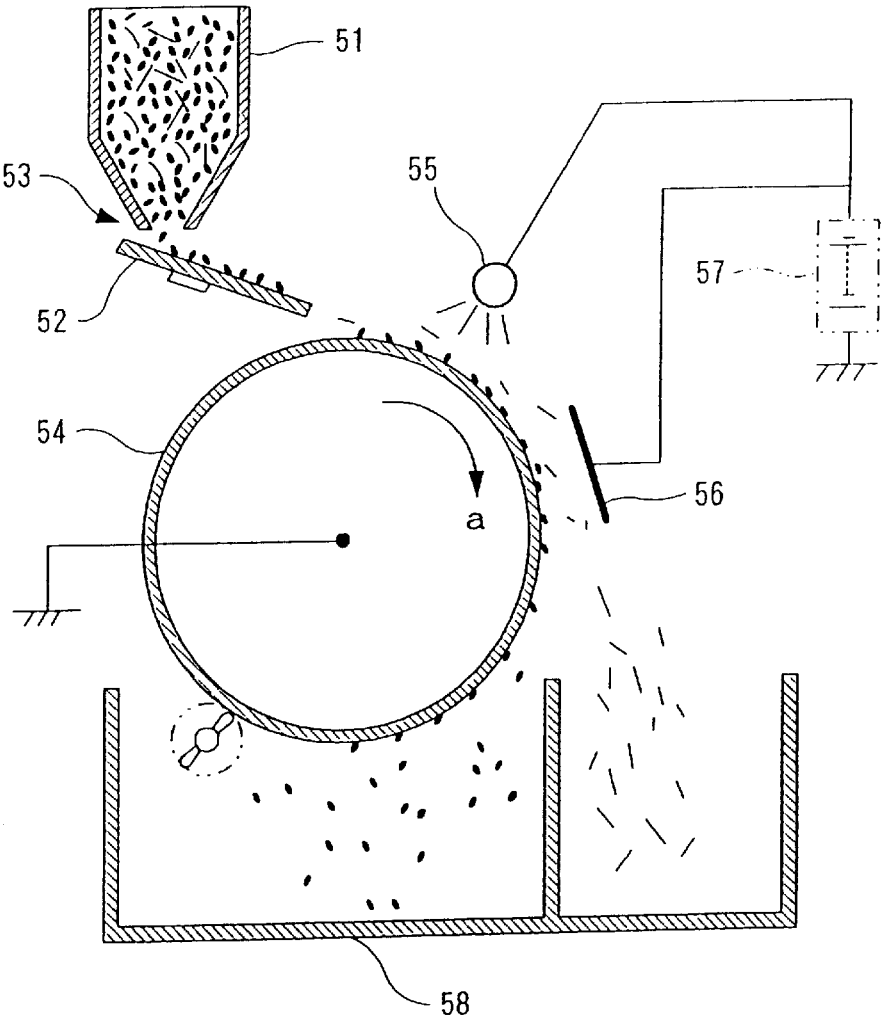
FIG. 9 (PRIOR ART)
FIG. 9 is a sectional view schematically showing a construction of a conventional composite sorting apparatus.

The experiments conducted by the inventors have the results shown in FIGS. 7 and 8.

That is, as shown in FIG. 7, when the distance X between the adjacent discharge sections meets $0<X/L_1\leqq 3$, the plastic recovery is ensured to be 90 wt %.

The experimental conditions are listed below.

Drum electrode 4—diameter: 40 cm (15.7480 in), width: 60 cm (23.6220 in)

First row of discharge electrodes 6—number of needle-shaped electrodes: 2 to 40, interval X between the discharge sections 5*a*: 1.5 to 20 cm (0.5906 to 7.8740 in)

Distance $L_1$ between the drum electrode 4 and the discharge section 5*a* of the needle-shaped electrode 5: 0.5 to 8 cm (0.1968 to 3.1496 in)

Distance D between the first row of discharge electrodes 6 and the second row of discharge electrodes 8: 5 cm (1.9685 in)

Plate-shaped electrode 9—length of the drum electrode 4 in its cross direction: 60 cm (23.6220 in), length of the drum electrode 4 in its rotating direction: 30 cm (11.8110 in), shortest distance $L_2$ between the plate-shaped electrode 9 and the drum electrode 4: 4 cm (1.5748 in)

Voltage $V_1$ applied between the needle-shaped electrode 5 and the drum electrode 4: 16 kV Voltage $V_2$ applied between the plate-shaped electrode. 9 and the drum electrode 4: 16 kV Circumferential speed of the drum electrode 4: 250 cm/sec (98.4252 in/sec)

Further, as shown in FIG. 8, when the voltage applied per 1 cm (0.3937 in) in the distance between the needle-shaped electrode 5 and the drum electrode 4 meets 0.5 kV/cm (1.27 kV/in)$\leqq V_1/L_1 \leqq$10 kV/cm (25.4 kV/in), the plastic recovery is ensured to be 90 wt %.

The experimental conditions in this case are listed below.

Drum electrode 4—diameter: 40 cm (15.7480 in), width: 60 cm (23.6220 in)

First row of discharge electrodes 6—number of needle-shaped electrodes 5: 40, interval X between the discharge sections 5*a*: 4 cm (1.5748 in)

Distance $L_1$ between the drum electrodes 4 and the discharge electrodes 5*a*: 3 cm (1.1811 in)

Distance D between the first row of discharge electrodes 6 and the second row of discharge electrodes 8: 5 cm (1.9685 in)

Plate-shaped electrode 9—length of the drum electrode 4 in its cross direction: 60 cm (23.6220 in), length of the drum electrode 4 in its rotating direction: 30 cm, (11.8110 in), shortest distance $L_2$ between the plate-shaped electrode 9 and the drum electrode 4: 4 cm (1.5748 in)

Voltage $V_1$ applied between the needle-shaped electrode 5 and the drum electrode 4: 5 to 33 kV Voltage $V_2$ applied between the plate-shaped electrode 9 and the drum electrode 4: 5 to 33 kV Circumferential speed of the drum electrode 4: 250 cm/sec (98.4252 in/sec)

Mixture A—mixture ratio of the copper wire A2: 10 to 70 wt %, type of the plastic pieces A1: PVC, PE, PS, or PP, mixture ratio of the plastic pieces A1: 70 to 30 wt %

What is claimed is:

1. A composite sorting apparatus comprising:

a rotationally moving electrode disposed so as to rotationally move in a predetermined direction;

a discharge electrode for corona discharge which is provided opposite the rotationally moving electrode at a predetermined distance therefrom; and a plate-shaped electrostatic electrode provided downstream of the discharge electrode and located opposite said rotationally moving electrode at a predetermined distance therefrom to form an electrostatic field between the electrostatic electrode and said rotationally moving electrode;

wherein high voltage of a polarity opposite to that of said rotationally moving electrode is applied between said rotationally moving electrode and both said discharge electrode and electrostatic electrode, a mixture of metal pieces and plastic pieces is loaded onto said rotationally moving electrode, corona ions are applied to the mixture from said discharge electrode, and the mixture is introduced into said electrostatic field so as to be separated into the metal pieces and the plastic pieces, the apparatus being characterized in that:

the discharge electrode has a plurality of discharge sections each having a sharp tip, the discharge sections are provided in a cross direction of the rotationally moving electrode at predetermined intervals, and arranged so that an interval X in cm (in) between adjacent discharge sections with respect to a distance $L_1$ in cm (in) from tips of the discharge sections to the rotationally moving electrode meets the following expression (1):

$$0<X/L_1 \leqq 3 \quad (1)$$

the discharge sections are each formed so that an area formed on the rotationally moving electrode and to which corona ions are applied has a diameter three times as large as the distance $L_1$ in cm (in), and a voltage $V_1$(kV) applied between said discharge electrode and said rotationally moving electrode meets the following expression (2):

$$0.5\ kV/cm\ 0.5\ kV/in \leqq V_1/L_1 \leqq 10\ kV/cm(25.4\ kV/in) \quad (2).$$

2. The composite sorting apparatus according to claim 1, characterized in that a plurality of rows each composed of a plurality of discharge sections arranged in the cross direction of said rotationally moving electrode are arranged in a rotational-movement direction of the rotationally moving electrode, and a distance D in cm (in) between the rows of discharge sections is set to meet the following expression (3):

$$D<3v+3L_1 \quad (3)$$

where v is a circumferential speed in cm/sec (in/sec) of the rotationally moving electrode.

3. The composite sorting apparatus according to claim 2, characterized in that said plurality of rows of discharge sections are formed so that the discharge sections of one row are located offset from the corresponding discharge sections of an adjacent row in the cross direction of the rotationally moving electrode.

4. The composite sorting apparatus according to any of claims 1 to 3, characterized in that said electrostatic electrode is formed to have, in a direction orthogonal to the rotational-movement direction of said rotationally moving electrode, a length that is substantially the same as the width of the rotationally moving electrode, the electrostatic electrode is formed to have, in the rotational-movement direction of said rotationally moving electrode, a length that is one-tenth or more of a diameter of the rotationally moving electrode, and a voltage $V_2$(kV) applied between the electrostatic electrode and rotationally moving electrode is set to meet the following expression (4):

$$0.5\ kV/cm(1.27\ kV/in) \leqq V_2/L_2 10\ kV/cm(25.4\ kV/in) \quad (4)$$

where $L_2$ is a shortest distance in cm (in) between the electrostatic electrode and the rotationally moving electrode.

* * * * *